US005264147A

United States Patent [19]

Houghton et al.

[11] Patent Number: 5,264,147

[45] Date of Patent: Nov. 23, 1993

[54] NARROW RANGE ETHOXYLATE-BASED LIQUID NONIONIC SURFACTANT BLENDS

[75] Inventors: Mark P. Houghton, Rotterdam; Johannes H. Rek, Vlaardingen; Arie de Weijer, Rotterdam; Rudolf C. Verheul, Utrecht, all of Netherlands

[73] Assignee: Unilever Patent Holdings B.V., Vlaardingen, Netherlands

[21] Appl. No.: 883,869

[22] Filed: May 15, 1992

[30] Foreign Application Priority Data

May 17, 1991 [GB] United Kingdom ..... 9110720

[51] Int. Cl.[5] ..... C11D 1/825; C11D 1/66; C11D 1/72; C11D 1/722

[52] U.S. Cl. ..... 252/174.22; 252/170; 252/174.21; 252/DIG. 1; 252/DIG. 14

[58] Field of Search ..... 252/174.21, 174.22, 252/DIG. 1, DIG. 14, 170

[56] References Cited

U.S. PATENT DOCUMENTS

| | | | |
|---|---|---|---|
| 4,441,881 | 4/1984 | Ruppert et al. | 8/137 |
| 4,474,678 | 10/1984 | Lutz et al. | 252/174.21 |
| 4,743,394 | 5/1988 | Kaufmann et al. | 252/90 |
| 4,886,615 | 12/1989 | Dehan | 252/90 |
| 4,889,644 | 12/1989 | Amberg et al. | 252/8.9 |
| 5,034,159 | 7/1991 | Tesmann et al. | 252/551 |
| 5,102,574 | 4/1992 | Russell et al. | 252/174.21 |
| 5,110,506 | 5/1992 | Ciallella | 252/559 |

FOREIGN PATENT DOCUMENTS

| | | |
|---|---|---|
| 158464 | 10/1985 | European Pat. Off. . |
| 225654 | 6/1987 | European Pat. Off. . |
| 295525 | 12/1988 | European Pat. Off. . |
| 490436 | 6/1992 | European Pat. Off. . |
| 91/12312 | 8/1991 | PCT Int'l Appl. . |
| 91/14765 | 10/1991 | PCT Int'l Appl. . |

*Primary Examiner*—Paul Lieberman
*Assistant Examiner*—A. Hertzog
*Attorney, Agent, or Firm*—Cushman, Darby & Cushman

[57] ABSTRACT

The pourability of a substantially non-aqueous liquid detergent upon storage at low temperatures may be ascertained by incorporating into it a liquid nonionic surfactant blend essentially consisting of:

(a) a narrow range linear chain alkyl ethoxylated alcohol containing an average of from about 5 to 7 ethylene oxide groups per molecule; and (b) an ethoxylated alcohol containing an average of from about 2 to 3 ethylene oxide groups per molecule, the weight ratio between (a) and (b) being in the range of from 9:1 to 1:9, whereby the average chain length ranges from 9 to 14 carbon atoms and the melting point of said blend is lower than 5° C., preferably lower than 0° C. This type of non-aqueous liquid detergent is particularly suitable for use in industrial washing machines.

7 Claims, No Drawings

NARROW RANGE ETHOXYLATE-BASED LIQUID NONIONIC SURFACTANT BLENDS

FIELD OF THE INVENTION

The present invention relates to a liquid nonionic surfactant blend which can be applied as liquid phase in a substantially non-aqueous liquid detergent composition. The invention relates also to a substantially non-aqueous liquid detergent composition comprising a liquid surfactant phase which contains this nonionic surfactant blend.

PRIOR ART AND BACKGROUND OF THE INVENTION

Non-aqueous detergent liquids have been proposed for a number of uses, such as fabric washing and dishwashing. They have advantages over powder products in that they are more rapidly dispersed in water. Further advantages over powder products are the possibility of automatic dosing and higher obtainable product densities resulting in lower transportation and packaging costs.

Non-aqueous detergent liquids have advantages over aqueous liquid products in that they are capable of including water-sensitive ingredients such as bleaches.

When non-aqueous liquid detergent compositions are used in industrial washing machines, they are generally stored in a cold environment (i.e. outdoors). Thus stored non-aqueous liquids will solidify upon storage if the melting point of the nonionic surfactant material used as liquid phase in these compositions, is not sufficiently low. As a consequence, these liquids are not any longer pumpable or pourable.

Another problem related to storage in a cold environment, is that at low temperatures the viscosity of the non-aqueous liquids may increase to such extent that they can no longer be easily and accurately dosed into a washing machine. Also with regard to pasty detergent compositions it is important that solidification does not occur at low temperatures.

It is known that non-aqueous liquid detergents with melting points lower than 0° C. can be obtained if the nonionic surfactants incorporated in the liquid phase of these non-aqueous liquids comprise alkoxylated alcohols containing propylene oxide groups. However, this type of nonionic surfactant is less preferred due to its restricted biodegradability.

It is also known that the melting point of a non-aqueous liquid detergent can be lowered by incorporating into it a low melting solvent such as ethanol or heptane. However, a large amount of this solvent—generally about 30% weight or more, as calculated on the total weight of the liquid phase—is needed for sufficient lowering of the melting point if the liquid phase of the non-aqueous liquid detergent contains mostly ethoxylated alcohol. This large amount of solvent has an adverse effect on the detergency to be obtained with the thus formulated non-aqueous liquid. Besides, phase separation will generally occur when this large amount of solvent is present in the formulation.

It is an object of the invention to provide a substantially non-aqueous liquid composition comprising a liquid surfactant phase which composition is pourable at 5° C., preferably at 0° C.

It is a further object to provide a non-aqueous liquid composition which is stable upon storage and gives effective detergency.

EP-A-295 525 (Henkel) discloses a washing process, wherein a pasty detergent product is applied which product may contain one or more types of ethoxylated alcohols. It is also known from this document that the incorporation of two types of ethoxylated alcohol into the pasty detergent product has a beneficial effect on the pourability of this product. However, it is not mentioned in this patent application that with special blends of ethoxylated nonionics containing a narrow range ethoxylated alcohol a melting point lower than 5° C. can be obtained.

We have surprisingly found that the above and other objects can be accomplished by applying special combinations of two types of ethoxylated alcohols as nonionic surfactants, of which types one being a narrow range ethoxylated alcohol, whereby the melting point of such combinations is lower than the melting point to be expected by linear interpolation.

DEFINITION OF THE INVENTION

The present invention provides a liquid nonionic surfactant blend suitable for use in non-aqueous liquid detergent products, the surfactant blend essentially consisting of:

(a) a narrow range linear chain alkyl ethoxylated alcohol containing an average of from about 5 to 7 ethylene oxide groups per molecule; and (b) an ethoxylated alcohol containing an average of from about 2 to 3 ethylene oxide groups per molecule, the weight ratio between (a) and (b) being in the range of from 9:1 to 1:9, whereby the average alkyl chain length ranges from 9 to 14 carbon atoms and the melting point of said blend is lower than 5° C.

The present invention also provides a substantially non-aqueous liquid detergent composition comprising a liquid phase which contains this liquid nonionic surfactant blend. In this context, "narrow range" means that at least 60% mol of the ethoxylated alcohol has a number of ethylene oxide groups within 2 EO groups of the average.

DETAILED DESCRIPTION OF THE INVENTION

It was found that liquid nonionic surfactant blends with melting points lower than 0° C. could be obtained when the weight ratio of the two types of ethoxylated alcohols contained in these blends is in the range of from 2:8 to 8:2. The reason is that the nonionic surfactant blends according to the invention are eutectic mixtures of which those with a weight ratio in the above mentioned range have the lowest melting points.

The best results with respect to the unexpected lowering of the melting point were achieved with surfactant blends consisting of a narrow range linear chain alkyl ethoxylated alcohol and a branched alkyl ethoxylated alcohol.

Non-aqueous liquid detergents according to the present invention include formulations only consisting of liquid constituents as well as formulations comprising a liquid surfactant phase and a solid phase dispersed therein.

In addition to the ethoxylated alcohols referred to above, non-aqueous liquid detergent products according to the invention may contain other surfactant materials as part of the liquid phase and/or dispersed as a solid phase, as described in more detail below.

Non-aqueous liquid compositions of the invention comprising a liquid surfactant phase and a solids phase dispersed therein may be prepared by any method known in the art. Such compositions are effectively prepared by mixing all ingredients in a stirred vessel, passing the obtained mixture through a colloid mill to break the largest particles, thereafter passing the mixture through a ball mill for further particle size reduction, de-aerating the mixture, and finally adding heat-sensitive ingredients such as perfume and enzymes. More information on preparing non-aqueous liquid formulations can be found in EP-A-385 521. Preferably, the compositions of the present invention also contain one or more dispersants for modifying the rheology of the dispersion. Most preferred are the deflocculants described in EP-A-266 199, for example dodecyl benzene sulfonic acid, lecithin, and linear alkyl sulphonic acids and their alkali metal, alkaline earth metal or aluminium salts.

Effective non-aqueous liquid detergent compositions according to the invention contain a solvent with a melting point lower than −10° C. and a boiling point higher than +100° C. If at most 20% by weight of this solvent (as calculated on the total weight of the liquid phase) is present, these compositions are generally suitable for all normal practical purposes. In view of detergency, preferably, at most 10% by weight of the solvent is present in the detergent composition. Good results with regard to an effective lowering of the melting point were accomplished when using triethylene glycol, propylene glycol, tri-ethylene glycol monoethylether, diethylene glycol monoethyl or -butylether as a solvent, or mixtures thereof.

The compositions according to the present invention may be formulated in a very wide range of specific forms according to the intended use. They may be formulated as cleaners for hard surfaces or as agents for ware washing either by hand or by mechanical means. They may also be formulated as agents for washing and/or conditioning of fabrics. Those last mentioned products constitute an especially preferred form of the present invention because in that role there is a very great need to be able to incorporate substantial amounts of various kinds of solids. These compositions may be of the kind used for pretreatment of fabrics with the composition neat or diluted, before they are rinsed or subjected to a main wash. The compositions may also be formulated as main wash products, being dissolved and/or dispersed in the water with which the fabrics are contacted. Examples of suitable anionic detergent surfactants, which may be used, preferably at most, in minor quantities are alkali metal or ammonium salts of alkyl benzene sulphonates having from 10 to 18 carbon atoms in the alkyl group, alkyl and alkylether sulphates having from 10 to 24 carbon atoms in the alkyl group, the alkylether sulphates having from 1 to 5 ethylene oxide groups.

Non-surfactants which are suitable for inclusion in the liquid phase include ethers, polyethers, alkylamines and fatty amines, alkyl or fatty amides and substituted derivatives thereof, alkyl or fatty carboxylic acid lower alkyl esters, ketones, aldehydes and glycerides. Preferably, thickening polymers and fluorescers are included in the liquid phase.

The compositions of the invention may contain the liquid phase in an amount of at least 10% by weight of the total composition. The amount of the liquid phase present in the composition may be as high as about 90%, but in most cases the practical amount will lie between 20 and 70% and preferably between 20 and 50% by weight of the composition.

The compositions of the invention may also optionally contain a solids phase dispersed in the liquids phase. In general the solids content of these compositions may be within a very wide range, for example from 1–90%, usually from 10–80%, preferably from 15–70%, especially from 15–50% by weight of the final composition. The solids may comprise sodium metasilicate, sodium tripolyphosphate, aluminosilicate, percarbonate, perborate and SOKALAN types of polymers. The solids should be in particulate form and have an average particle size of less than 300 microns, preferably less than 200 microns, more preferably less than 100 microns, a particle size of less than 10 microns being especially preferred. The solids particles may even have a sub-micron size. The proper particle size can be obtained by using materials of the appropriate size or by milling the total product in a suitable milling apparatus.

The compositions according to the present invention preferably also contain one or more other functional ingredients, for example selected from detergency builders, bleaches, antifoaming agents, alkalinity boosters (for hard surface cleaners), abrasives, fluorescers, antideposition agents, and softening clays.

The detergency builders comprise both inorganic and organic builders. They may also be subdivided into phosphorus-containing (e.g. sodium tripolyphosphate) and non-phosphorus types, the latter being preferred when environmental considerations are important. The level of builder materials is preferably from 0–60% by Weight of the composition, more preferred from 10–50%, most preferred from 20–40%. Especially preferred builders are SOKALAN types of polymers, poly-acrylates, sodium citrate, zeolite and nitrilotriacetic acid. In general, polymers of the class of acrylate and methacrylate copolymers and homopolymers may be used as alternatives to SOKALAN polymers. They may also be added as stabilisers against sedimentation and for anti-ashing and anti-redeposition purposes.

Preferred bleaches, particularly in the application for fabric washing, are the oxygen bleaches, for example in the form of an inorganic persalt, preferably with a precursor, or as a peroxy acid compound.

As an alkalinity booster preferably sodium metasilicate is applied as an ingredient of the non-aqueous liquid composition according to the present invention. The reason is that detergency is improved especially with regard to the removal of particulate soils, owing to the high pH-value of above 12 obtainable with this alkalinity booster. With respect to the foaming behaviour of compositions according to the invention good results were obtained when using a combination of a hydrocarbon wax and alkyl phosphate as an antifoaming agent. It appeared that good defoaming characteristics can be obtained after both separate and combined addition of these compounds to the composition of the invention. Alternatively, silicone oil based compositions containing both high and low viscosity oil, particularly high viscosity silicone oil having a viscosity greater than 3000 mPa.s at 25 ° C. and $2^{-1}$, may be effectively used as antifoaming agents.

The invention will now illustrated by way of the following non-limiting examples in which parts are by weight unless otherwise stated.

In the examples the following abbreviations are used:

Vista Novel 1012-62: C10–C12 narrow range ethoxylated alcohol containing an average of about 6 EO-groups (ex VISTA Chemical Co);

Genapol UD 030 :C12 branched alkyl ethoxylated alcohol containing about 3 EO-groups (ex Hoechst);

Genapol GX 030 :C12 branched alkyl ethoxylated alcohol containing about 3 EO-groups with limited free polyethylene glycol content (ex Hoechst);

Dobanol 91-2.5 : C9–C11 linear alkyl ethoxylated alcohol containing an average of about 2.5 EO-groups (ex Shell);

Dobanol 91-5.35 : C9–C11 narrow range linear alkyl ethoxylated alcohol containing an average of about 5.35 EO-groups (ex Shell);

Alf5/ Wax 1:1: Defoaming agent consisting of alkylphosphate and hydrocarbon wax in a weight ratio of 1:1 (ex LANKRO);

ABSA :Alkyl benzene sulfonic acid (ex Huls);

MgO: Magnesium-oxide (ex Merck);

SMS: anhydrous sodium metasilicate (ex EKA Chemical Co);

SCMC: Sodium Carboxy methyl cellulose;

Sokalan CP7 (powder): an acrylic acid/maleic acid copolymer in the sodium salt form (ex BASF);

EXAMPLES 1-5

The following nonionic surfactant blends were prepared:

| | Example | | | | |
|---|---|---|---|---|---|
| Ingredients | 1 parts | 2 parts | 3 parts | 4 parts | 5 parts |
| Vista Novel 1012-62 | 30 | 40 | 70 | | |
| Genapol UD 030 | 70 | | | | |
| Genapol GX 030 | | 60 | | 50 | |
| Dobanol 91-2.5 | | | 30 | | 70 |
| Dobanol 91-5.35 | | | | 50 | 30 |
| Expected melting point (°C.) | 5 | 5 | 5 | 2 | −2 |
| Observed melting point (°C.) | 2 | −2 | 3 | −3 | −5 |

The above shown expected melting points were derived by linear interpolation of the melting points of the surfactants constituting the respective nonionic surfactant blends. It can be seen that in all these cases the observed melting point is clearly lower than the expected melting point. The melting points were measured by first cooling samples of the surfactant blends to −15° C., thereafter very slowly heating up these samples at a rate of about 4° C. per hour, and finally determining the endpoint of the melting trajectory, i.e. the lowest temperature at which the whole sample is molten.

EXAMPLES 6-7

Two different sustantially non-aqueous liquid products were prepared:

| | Examples | |
|---|---|---|
| Ingredients | 6 parts | 7 parts |
| Vista Novel 1012-62 | 19.55 | 40.55 |
| Genapol UD 030 | 19.55 | |
| Alf5/Wax 1:1 | 1.00 | 1.00 |
| ABSA | 3.00 | 3.10 |
| MgO | 0.17 | 0.17 |
| SMS | 44.50 | 46.10 |
| SCMC | 1.50 | 1.55 |
| Sokalan CP7 (powder) | 5.00 | 5.20 |
| Minor ingredients | 3.20 | 3.20 |

It was observed that liquid product (6) being within the scope of the present invention, is pourable after storage for two months at 0° C. On the other hand, liquid product (7) appeared to have solidified after storage for 1 week at 5° C.

We claim:

1. A non-aqueous liquid nonionic surfactant blend, the surfactant blend consisting essentially of:

(a) a narrow range linear chain alkyl ethoxylated alcohol containing an average of from about 5 to 7 ethylene oxide groups per molecule; and (b) a branched alkyl ethoxylated alcohol containing an average of from about 2 to 3 ethylene oxide groups per molecule, the weight ratio between (a) and (b) being in the range of from 9:1 to 1:9, whereby the average chain length of (a) and (b) ranges from 9 to 14 carbon atoms and the melting point of said blend is lower than 5° C.

2. Surfactant blend according to claim 1, wherein the weight ratio between (a) and (b) is in the range of from 2:8 to 8:2.

3. Substantially non-aqueous liquid detergent composition comprising a liquid surfactant phase which contains the nonionic surfactant blend according to claim 1.

4. Composition according to claim 3, wherein a solid phase is dispersed in the liquid surfactant phase.

5. Composition according to claim 3, wherein the liquid phase contains at most 20% by weight as calculated on the total weight of the liquid phase, of a solvent with a melting point lower than −10° C. and a boiling point higher than 100° C.

6. Composition according to claim 5, wherein the solvent is selected from the group consisting of tri-ethylene glycol, propylene glycol, tri-ethylene glycol monoethylether, diethylene glycol monomethylether, and mixtures thereof.

7. Composition according to claim 5, wherein the liquid phase contains at most 10% by weight of the solvent.

* * * * *